United States Patent [19]

Uebel et al.

[11] Patent Number: 4,570,401

[45] Date of Patent: Feb. 18, 1986

[54] DEVICE FOR ADJUSTABLY MOUNTING FACING PLATES

[75] Inventors: Philipp Uebel, Prien; Jaroslav Rousek; Raimer Uhlig, both of Munich, all of Fed. Rep. of Germany

[73] Assignee: Hilti Aktiengesellschaft, Schaan Fürstentum, Liechtenstein

[21] Appl. No.: 652,455

[22] Filed: Sep. 19, 1984

[30] Foreign Application Priority Data

Sep. 20, 1983 [DE] Fed. Rep. of Germany ..... 3333954

[51] Int. Cl.[4] ..... E04G 21/00; E04G 23/00

[52] U.S. Cl. ..... 52/235; 52/585

[58] Field of Search ..... 52/235, 271, 585, 586, 52/590

[56] References Cited

U.S. PATENT DOCUMENTS 3,438,164 4/1969 Duepree ..... 52/585 X
3,815,309 6/1974 Olsen ..... 52/235 X
4,483,122 11/1984 Crandell ..... 52/235 X

FOREIGN PATENT DOCUMENTS

0064290A1 11/1982 European Pat. Off. .
2208194 9/1973 Fed. Rep. of Germany ..... 52/235
2439267 2/1976 Fed. Rep. of Germany ..... 52/235
2543174 3/1977 Fed. Rep. of Germany ..... 52/235

*Primary Examiner*—John M. Jillions
*Attorney, Agent, or Firm*—Toren, McGeady, Stanger, Goldberg & Kiel

[57] ABSTRACT

A device for adjustably mounting facing plates on a structure includes an elongated L-shaped supporting member made up of a first leg or web and a second leg or web. One surface on each of the first and second legs of the supporting member is toothed. An abutment also having a toothed surface is arranged to intermesh with the toothed surface on the first leg of the supporting member. The toothed surface of the second leg extends in the long direction of the supporting member and intermeshes with a similar toothed surface on a supporting plate. Supporting bolts are connected to the supporting plate and project into receiving holes in the facing plates. The second leg of the supporting member has an opening through which one of the supporting bolts can pass. For aligning adjacent facing plates the transversely extending dimensions of the opening in the second plate are selected as multiples of the diameter of the supporting bolts.

8 Claims, 2 Drawing Figures

DEVICE FOR ADJUSTABLY MOUNTING FACING PLATES

SUMMARY OF THE INVENTION

The present invention is directed to a device for adjustably mounting facing plates and similar members on a structure. The device includes an abutment which can be anchored to the structure. A supporting member with an essentially L-shaped transverse section is arranged so that the abutment and one leg of the supporting member have facing surfaces in meshed engagement. One or more supporting bolts are arranged for insertion into receiving bores in the facing plates and the supporting bolts project perpendicularly from one side of the other leg of the supporting member.

One purpose of facing plates is to protect a structure from atmospheric and other external conditions. Another purpose of the facing plates is to provide a specific visual or architectural effect. Particularly in connection with rear ventilation, facing plates can afford an additional thermal insulation. Primarily for esthetic reasons, it is required that the facing plates be aligned relative to one another so that all of the outwardly directing surfaces of the plates lie in a single plane or adjacent plates are arranged to provide a specific groove width between them.

In a known system, the facing plates are mounted one after the other and the structure is drilled with holes so that the plates can be connected to the structure by fastening elements. As a result, the individual attachment locations on the facing plates are not adjustable whereby the mounting or assembling procedure requires very careful mounting procedures by the personnel setting the facing plates. Further, this procedure is very impractical because it requires continuous changing from drilling holes into the structure to placing the fastening elements and mounting the facing plates.

In another known system in use at the present time, the points for fastening the facing plates to the structure are at least partially adjustable. This system affords a significantly more practical mounting of the facing plates so that a specific pattern of all or at least a part of the bores required to hold the fastening elements can be made in the structure with the subsequent placement of the fastening elements. This system makes particular use of so-called adhesive anchors which require a certain setting period until the anchors can be stressed. The setting period can range from a few minutes up to several hours depending on the composition of the adhesive substance and the ambient temperature. This system is especially useful on larger structures, that is, separate especially trained assembly personnel can be used for placing the fastening elements and mounting the facing plates.

In still another known system, initially a cylindrical tube is anchored in the wall of the structure, possibly extending through insulation. The facing plates are mounted using an abutment with an expansion dowel-like extension which can be secured in the tube at a desired distance from the structure wall using the expansion procedure. In addition, this system includes an essentially L-shaped supporting member which can be connected to the abutment in a desired position using a clamping screw. To absorb transverse forces, the abutment and the supporting member are provided on opposing sides with toothed surfaces which engage one another during the assembly operation. In addition, the leg of the supporting member, extending from the leg in meshed engagement with the abutment, has supporting bolts which project from both sides of the leg and essentially perpendicularly to it. During the assembly of the facing plates, these supporting bolts are inserted into receiving bores in the facing plates arranged to receive the bolts.

In this known system, there is the disadvantage that the clamping screw must be loosened for aligning the facing plates or for the adjustment of the mounting device. When the clamping screw is loosened, the device is adjustable at the same time in three directions perpendicular to one another and this feature makes alignment extremely difficult. After the facing plate which rests on the supporting member is set in place, the clamping screw is usually no longer accessible or is accessible only with difficulty.

The present invention is directed to a device for adjustably mounting facing plates on a structure which affords a simple and reasonable mounting and aligning assembly arrangement.

In accordance with the present invention, the supporting member has a web or leg with a toothed surface and supporting bolts are connected to a supporting plate with a complementary toothed surface for engaging the toothed surface on the leg of the supporting member.

In accordance with one embodiment of the present invention, the supporting bolts are not connected directly to the supporting member but to the adjustable supporting plate. One leg of the supporting member and the supporting plate are connected together in a form-locking manner by the toothed surfaces on the two parts. Due to the toothed surfaces with the teeth extending in the long direction of the supporting member, the supporting plate and the supporting bolts can be shifted relative to the supporting member in the long direction of the member. Further, a stepped adjustment, corresponding to the spacing of the toothed surfaces, is possible in the direction extending perpendicular to the long direction of the teeth, that is, the long direction of the supporting member. As a consequence, a two-dimensional adjustment of the supporting plate or the supporting bolt relative to the supporting member can be effected. It is not necessary to loosen the mounting device in effecting the adjusting operation. The alignment of the mounting device in the two directions takes place independently from any adjustment in the third direction, usually the vertical direction.

For the secure mounting of the facing plates, the plates are usually connected at their upper and lower edge faces with the structure. The lower fasteners primarily carry the weight of the facing plates, while the upper fasteners are stressed in practice only by transverse forces due to wind pressure and any deviation of the facing plates from a vertical position. To effect a simple adjustment of the supporting plate relative to the supporting member, it is advantageous if the supporting bolts are connected essentially perpendicularly to the plane of the surface of the supporting plates. Further, the leg of the supporting member through which the supporting bolt extends preferably has an opening arranged to receive the supporting bolt. The toothed surface on the leg of the supporting member arranged to interengage with the toothed surface on the supporting plate, is located preferably on the upwardly facing side of the leg of the supporting member. When using appropriate auxiliary connecting means, such as screws, nuts, adhesive or the like, the toothed, construction may also be arranged on the downwardly facing side of the leg of the supporting member. Due to the provision of supporting bolts projecting from both of the opposite sides of the supporting plate, adjacent lower and upper facing plates can be aligned at the same time.

To provide sufficient adjustability, it is advantageous that the transversely extending dimensions of the opening in the leg of the supporting member, arranged to receive the supporting bolts, amount to a multiple of the corresponding dimension of the transverse area of the supporting bolt. The adjustment dimension for the supporting bolt occurs as a result of the oversize of the opening with regard to the corresponding dimension of the bolt.

When the facing plates are mounted on a structure, primarily the distance of the facing plate from the surface of the structure is an important consideration. Further, it should be possible to align the facing plate in the general horizontal direction extending parallel to the surface of the structure. To afford such adjustment, it is advantageous if the dimensions of the opening in the leg of the supporting member for receiving the supporting bolt in the transversely extending directions are a multiple of the corresponding dimensions of the cross-section of the supporting bolt. When the supporting bolt has a circular cross-section, the dimension of the opening through the leg of the supporting member should be approximately twice the diameter of the bolt. Due to the fastening points of the facing plates which are held in the long direction of the supporting members only by the frictional force based on their weight, any longitudinal changes in the facing plates and the structure due to temperature differences can be balanced.

Considerable forces directed essentially perpendicularly to the surface of the facing plates may develop because of wind pressure acting against the facing plates of the structure. To transfer such forces to the structure, it is advantageous that the toothed surface on the leg of the supporting member receiving the supporting bolts extend essentially in the long direction of the supporting member when the member has an L-shaped cross-section. Due to such an embodiment, the forces acting at the surface plates are transferred via the toothed surfaces in a form-locking manner to the structure. Due to this form-locking engagement, it is virtually impossible for the distance from the wall of the facing plates to the structure to be changed by external forces.

With the exception of the uppermost fastening members for the facing plates, a part of the supporting plates is connected to the supporting member only by the weight or the corresponding frictional force of the upper facing plate which rests upon it. For temporarily fixing the upper fastening members of a facing plate until the next upper facing plate is mounted, it is advantageous to provide an essentially U-shaped clamp for securing the supporting plate on the leg of the supporting member. The clamp can be removed after the next upper facing plate is placed or it may be left in the mounting device.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
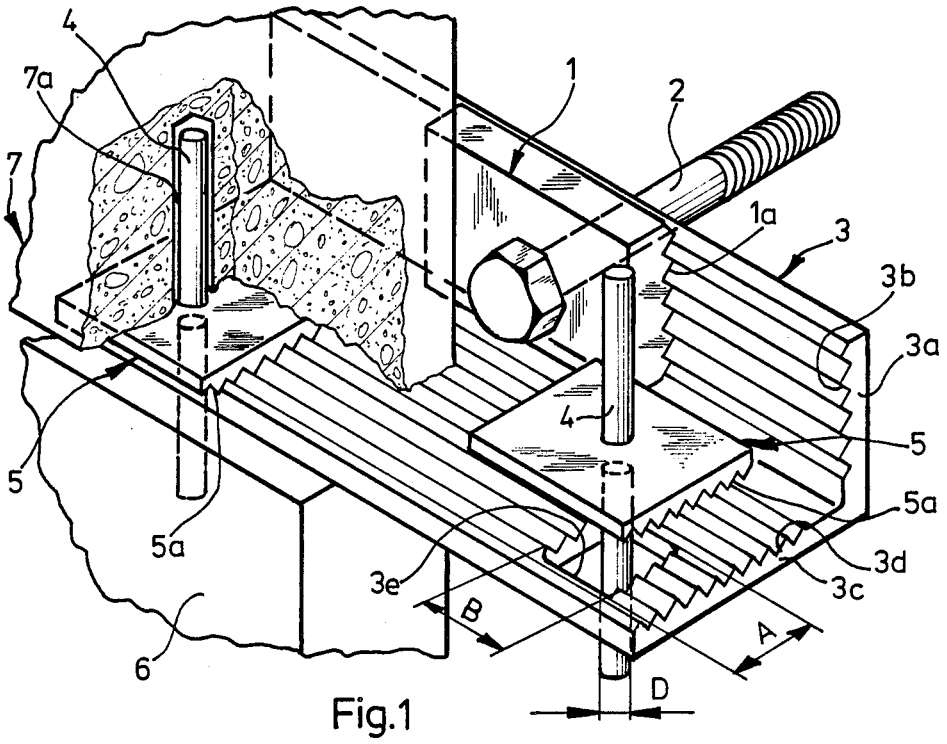
FIG. 1 is a perspective view, partially in section, of a mounting device embodying the present invention.

In the device illustrated in FIG. 1, an abutment 1 has a toothed surface 1*a* directed toward the structure, not illustrated, to which the mounting device is to be secured. A threaded bolt 2 extends through the abutment 1 and can be anchored in the wall of the structure. The bore in the abutment 1 for the threaded bolt 2 has basically the same diameter as the shank of the threaded bolt. The abutment 1 is connected to an L-shaped supporting member 3. Supporting member 3 has a first web or leg 3*a* extending essentially parallel to the surface of the structure and the surface of the leg facing outwardly from the structure toward the abutment 1 has a toothed surface 3*b* corresponding to the toothed surface 1*a* on the abutment. As viewed in FIG. 1 the leg 3*a* extends upwardly from the other leg 3*c* in the vertical direction, accordingly, leg 3*c* extends in the horizontal direction. The supporting member 3 is elongated. For the vertical adjustability of the mounting device, the first leg 3*a* of the supporting member has an oblong hole, not shown in FIG. 1 but note FIG. 2, with the oblong direction extending vertically. The abutment 1 and the toothed surface 3*b* of the first leg 3*a* on the supporting member 3 may be located on the opposite side of the first leg, that is, the side which faces the structure. Second leg 3*c* of the supporting member 3 extends perpendicularly from the first leg 3*a* in the direction away from the structure. The second leg 3*c* has a toothed surface 3*d* facing upwardly. The teeth forming the toothed surface 3*d* extend in the direction of the long dimension of the supporting member 3. The second leg 3*c* of the supporting member 3 has openings 3*e* for permitting the passage of supporting bolts 4 having a circular cross-section. Supporting bolts 4 extend substantially perpendicularly to the second leg 3*c* and they are connected with a supporting plate 5. As viewed in FIG. 1, the supporting plate has an upwardly facing surface and a downwardly facing surface and the downwardly facing surface is a countertoothed surface 5*a* complementary to the toothed surface 3*d* of the second leg 3*c* of the supporting member 3. On the left-hand portion of the supporting member 3 as viewed in FIG. 1, a first or lower facing plate 6 is located below and extends downwardly from the lower surface of the second leg 3*c*. As shown in dashed lines, a supporting bolt 4 projects downwardly from the supporting plate 5 through the second leg 3*c* into a receiving bore in the facing plate 6. A second or upper facing plate 7, shown partly in section, is provided with a vertically extending receiving bore 7*a* into which the upwardly extending supporting bolt 4 on the plate 5 seats. The diameter of the receiving bore 7*a* corresponds approximately to the diameter D of the supporting bolt 4. Alignment of the lower and upper facing plates 6, 7 is effected by shifting the supporting plates along the toothed surface 3*d* of the supporting member 3. To adjust the distance of the facing plates 6, 7 from the vertical surface of the structure, a temporary disengagement is effected between the toothed surface 3*d* and the counter-toothed surface 5*a* so that the desired meshed engagement of the supporting plate 5 and the supporting member 3 can be effected relative to the vertically directed surface of the structure. When the toothed surface 3*d* and the counter-toothed surface 5*a* are engaged they are locked in position relative to the vertical surface of the structure. To afford an adequate adjustability of the facing plate 7, the transversely extending dimensions A and B of the openings 3*e* through the second leg 3*c* are preferably a multiple of the diameter D of the supporting bolts 4. The toothed surface 3*d* and the complementary toothed surface 5*a* are held in meshed engagement with one another due to the weight of the upper facing plate 7.

For the purpose of clearer illustration, in FIG. 1, the right-hand supporting plate 5 is shown spaced upwardly from the second web 3*c*. In this elevated position, the supporting plate 5 and the connected supporting bolt 4 is adjustable in the two directions indicated by the dimensions A and B relative to the supporting member 3.

Figure 2:
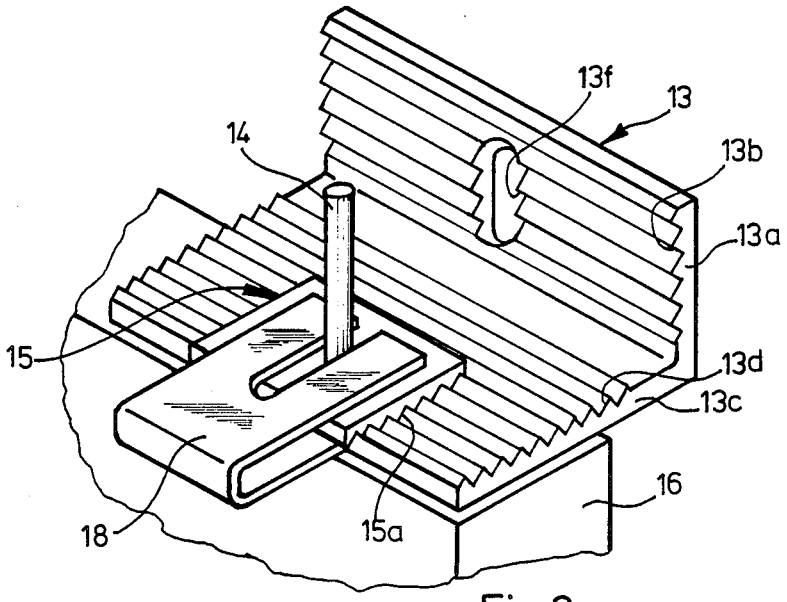
FIG. 2 is a perspective view illustrating another embodiment of the present invention including an additional safety clamp.

The mounting device for facing plates displayed in FIG. 2 corresponds basically to the embodiment shown in FIG. 1. The mounting device includes a supporting member 13, supporting bolts 14 which are adjustably positionable with respect to the supporting member 13, and a supporting plate 15 to which the supporting bolts are connected. The supporting member 13 has a vertically arranged first leg 13*a* and the leg has a toothed surface 13*b* for meshed engagement with an abutment, not shown. Since the abutment is not illustrated in FIG. 2, an oblong hole 13*f* in the first leg 13*a* can be seen. A threaded bolt, not shown, but similar to the one in FIG. 1, would extend through the oblong hole so that vertical adjustability is available. A second leg 13*c* has an upwardly facing toothed surface 13*d*. The supporting plate 15 mounting the supporting bolts 14 covers the opening in the second leg 13*c*. The supporting plate 15 has a toothed surface 15*a* complementary to the toothed surface 13*d* so that the two surfaces fit in meshed interengagement. The lower part of the supporting bolt 14, not shown, projects downwardly into a hole or bore in facing plate 16 located below the supporting member 13. Until the upper facing plate is positioned, any shifting of the supporting plate 15 and, as a result, of the supporting bolt 14, the supporting plate is secured in position by a U-shaped clamp 18 slotted to receive and secure the supporting bolt 14.

While specific embodiments of the invention have been shown and described in detail to illustrate the application of the inventive principles, it will be understood that the invention may be embodied otherwise without departing from such principles.

We claim:

1. A mounting device for adjustably mounting facing plates and similar members on a structure including an abutment arranged to be anchored to the structure, said abutment having a first surface facing the structure and an oppositely directed second surface, an elongated supporting member having an L-shaped cross-section transverse to the elongated direction thereof, the L-shaped cross-section of said supporting member comprises a first leg and a second leg extending approximately perpendicularly of said first leg, said legs extending in the long direction of said supporting member and each having a first surface and a second surface facing in opposite directions, said abutment and said first leg of said support member arranged to be positioned in contacting engagement, first means formed on the contacting surfaces of said abutment and said first leg for affording meshed interengagement therebetween, at least one supporting bolt arranged to extend into a receiving bore in one of the facing plates, said supporting bolt arranged to extend perpendicularly to said second leg of said supporting member and to project outwardly from said second leg, wherein the improvement comprises second means formed on one of said first and second surfaces of said second leg for effecting a meshed interengagement, and a supporting plate having a first surface and a second surface with said at least one supporting bolt connected to and extending outwardly from at least one of the first and second surfaces of said supporting plate, one of said first and second surfaces of said supporting plate arranged to contact the one of said first and second surfaces of said second leg on which said second means are formed, and third means formed on the one of said first and second surfaces of said supporting plate for effecting meshed interengagement with said second means.

2. A mounting device, as set forth in claim 1, wherein said first means, second means and third means comprise a plurality of parallel teeth extending in the long direction of said supporting member.

3. A mounting device, as set forth in claim 1 or 2, wherein said at least one supporting bolt comprises a supporting bolt extending perpendicularly outwardly from each of the first surface and second surface of said supporting plate, and said second leg of said supporting member has at least one opening therethrough between the first and second surfaces thereof for receiving said supporting bolt extending from said supporting plate.

4. A mounting device, as set forth in claim 3, wherein said supporting bolt has a transverse dimension D, said opening in said second leg of said supporting member has a dimension A extending transversely of the long direction of said supporting member and said dimension A is a multiple of the dimension D of said supporting bolt.

5. A mounting device, as set forth in claim 4, wherein said opening in said second leg of said supporting member has a dimension B extending in the long direction of said supporting member and said dimension B is a multiple of the dimension D of said supporting bolt.

6. A mounting device, as set forth in claim 1 or 2, including an essentially U-shaped clamp arranged to fit over said supporting plate and said second leg of said supporting member in the interengaged condition and said clamp having slots therein arranged to receive and contact said supporting bolt for securing said supporting plate against displacement.

7. A mounting device, as set forth in claim 1 or 2, wherein said first surface of said first leg of said supporting member is arranged to face away from the structure and is arranged to interengage the first surface of said abutment, said first leg of said supporting member is arranged to extend substantially vertically and said second leg of said supporting member is arranged to extend substantially horizontally, said second leg of said supporting member has the first surface thereof facing upwardly and the second surface thereof facing downwardly with said first surface having said second means formed thereon.

8. A mounting device, as set forth in claim 7, wherein said first leg of said supporting member has an oblong hole therein extending in the vertical direction, and a bolt arranged to extend through said abutment and said oblong hole and to fit into a bore in the structure so that said supporting member can be adjusted in the vertical direction relative to said bolt.

* * * * *